US009677307B2

(12) United States Patent
McCuistion

(10) Patent No.: US 9,677,307 B2
(45) Date of Patent: Jun. 13, 2017

(54) VERTICALLY FLOATING HINGE

(71) Applicant: Michael T. McCuistion, Columbia, MO (US)

(72) Inventor: Michael T. McCuistion, Columbia, MO (US)

( * ) Notice: Subject to any disclaimer, the term of this patent is extended or adjusted under 35 U.S.C. 154(b) by 0 days.

(21) Appl. No.: 14/592,065

(22) Filed: Jan. 8, 2015

(65) Prior Publication Data

US 2016/0201366 A1 Jul. 14, 2016

(51) Int. Cl.
*E05D 3/02* (2006.01)
*A47B 53/02* (2006.01)

(52) U.S. Cl.
CPC ..... *E05D 3/022* (2013.01); *A47B 53/02* (2013.01)

(58) Field of Classification Search
CPC ..... A47B 43/00; E05D 3/022; Y10T 16/5327; Y10T 16/5361; Y10T 16/539
USPC ..... 211/150; 16/229, 233, 243, 248
See application file for complete search history.

(56) References Cited

U.S. PATENT DOCUMENTS 241,123 A * 5/1881 Danner ..... A47B 49/004 312/199
1,103,607 A * 7/1914 Moore ..... E05D 7/0027 16/244
1,508,013 A * 9/1924 De Waters ..... E05D 3/022 16/351
1,833,972 A * 12/1931 Olson ..... E06B 3/52 16/243
1,869,542 A * 8/1932 Chamberlain ..... E05D 3/02 16/309
2,373,955 A * 4/1945 Fuller ..... E05D 7/0423 126/194
D150,194 S * 7/1948 Waters ..... 312/140.2
2,588,258 A * 3/1952 Lowman ..... E05D 7/0027 16/243
4,478,467 A * 10/1984 Tyndall ..... A47B 43/00 211/87.01
5,058,236 A * 10/1991 Henson ..... E05D 7/0027 16/222
5,201,097 A * 4/1993 Phillips ..... E05D 7/0027 16/243
D339,482 S * 9/1993 Naylor ..... D6/642
D372,607 S * 8/1996 Pallas ..... D6/671.1
5,558,418 A * 9/1996 Lambright ..... A47B 21/00 248/188.1
D377,126 S * 1/1997 Foco ..... D6/642
5,720,082 A * 2/1998 Rossmo ..... E05B 15/0006 16/244

(Continued)

*Primary Examiner* — Joshua Rodden
(74) *Attorney, Agent, or Firm* — Dale J. Ream

(57) ABSTRACT

A vertically floating hinge includes a pin having a linear configuration, a first leaf, and a second leaf. The first leaf includes a pair of spaced apart first-leaf knuckles rotatably coupled to the pin. The second leaf includes at least one second-leaf knuckle rotatably coupled to the pin, the second-leaf knuckle situated between the pair of spaced apart first-leaf knuckles and configured to slide along the pin between the pair of first-leaf knuckles. The first-leaf knuckles are spaced apart from one another and define a first-leaf space therebetween, each first-leaf knuckle defining a first-leaf knuckle channel configured to receive the pin therethrough. The at least one second-leaf knuckle is smaller than the first-leaf space so as to selectively slide vertically along the pin between the pair of first-leaf knuckles.

5 Claims, 5 Drawing Sheets

(56) References Cited

U.S. PATENT DOCUMENTS

| | | | | | |
|---|---|---|---|---|---|
| D440,429 | S | * | 4/2001 | Wales | D6/671 |
| D655,947 | S | * | 3/2012 | Doane | D6/661 |

* cited by examiner

VERTICALLY FLOATING HINGE

BACKGROUND OF THE INVENTION

This invention relates generally to hinges and, more particularly, to a vertically floating hinge having first and second leaf portions that move selectively upwardly or downwardly along an upstanding connection pin.

Objects having two or more sections are often connected with hinges so that the two sections may be moved pivotally relative to one another. For instance, a door is mounted to a door frame and is, as a result, pivotally movable between open and closed configurations. Similarly, a cabinet door is mounted to a cabinet wall and is, as a result, movable between a closed configuration preventing access to the cabinet and an open configuration allowing access.

Although effective for most applications, traditional hinges are less effective if the two sections of an object do not remain in the same horizontal plane throughout a movement between the open and closed configurations. For instance, a shelving unit that is pivotal relative to a wall or another shelving unit via a hinge may not move efficiently or may even be damaged if a floor surface beneath the movable unit is not level. Specifically, if a roller supporting the moving portion is at times in contact with the floor and at other times suspended from the shelving unit above the floor, the hinge itself may be damaged by the weight of the shelf portion not being adequately supported.

Therefore, it would be desirable to have a vertically adjustable hinge that includes a pair of leaves movable in a vertical (i.e. up-down) direction that enables the portions of a work piece, such as a pivotally adjustable shelving system, to be coupled together via the leaves of the hinge so as to maintain the shelving portions in a common horizontal plane. Further, it would be desirable to have a vertically adjustable hinge in which the leaves of the hinge slide vertically along a pin relative to one another in association with movement of the work piece portions to which they are mounted. It would be desirable to move have an adjustable hinge that enables shelf portions operable upon rollers to which the hinge is coupled to move up or down with elevation changes in a floor surface such that corresponding rollers maintain contact with the floor to support the weight of the shelf assembly.

SUMMARY OF THE INVENTION

A vertically floating hinge according to the present invention includes a pin having a linear configuration, a first leaf, and a second leaf. The first leaf includes a pair of spaced apart first-leaf knuckles rotatably coupled to the pin. The second leaf includes at least one second-leaf knuckle rotatably coupled to the pin, the second-leaf knuckle situated between the pair of spaced apart first-leaf knuckles and configured to slide along the pin between the pair of first-leaf knuckles. The first-leaf knuckles are spaced apart from one another and define a first-leaf space therebetween, each first-leaf knuckle defining a first-leaf knuckle channel configured to receive the pin therethrough. The at least one second-leaf knuckle is smaller than the first-leaf space so as to selectively slide vertically along the pin between the pair of first-leaf knuckles.

Therefore, a general object of this invention is to provide a vertically floating hinge that allows portions of an object coupled by the hinge to move vertically during operation of the hinge.

Another object of this invention is to provide a vertically floating hinge, as aforesaid, having first and second hinge leaves movable vertically relative to one another along a vertical pin.

Still another object of this invention is to provide a vertically floating hinge, as aforesaid, that avoids damage due to the weight of portions of rotatable structures coupled by a hinge.

Yet another object of this invention is to provide a vertically floating hinge, as aforesaid, that has the appearance of a traditional hinge.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
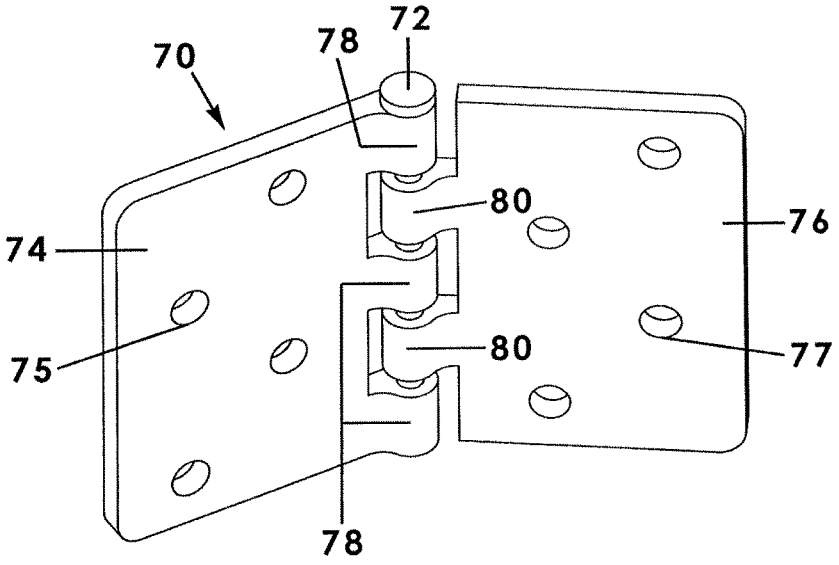
FIG. 1*a* is a perspective view of a floating hinge system illustrated in a neutral configuration.

A vertically floating hinge according to a preferred embodiment of the present invention will now be described with reference to FIGS. 1 to 4*b* of the accompanying drawings. The vertically floating hinge 70 includes a first leaf 74, at least a pair of first-leaf knuckles 78, a second leaf 76, at least one second-leaf knuckle 80, and a pin 72 about which the leaves may rotate via respective knuckles.

The floating hinge 70 is configured to enable an attached work piece, such as a shelf assembly having rolling portions, to move upward if a corresponding roller rolls onto a raised surface or, conversely, to enable an attached shelf assembly to move downward if a corresponding roller rolls into a recessed surface. This configuration alleviates the strain on the hinges so as to reduce failures or damage thereto.

Figure 2A:
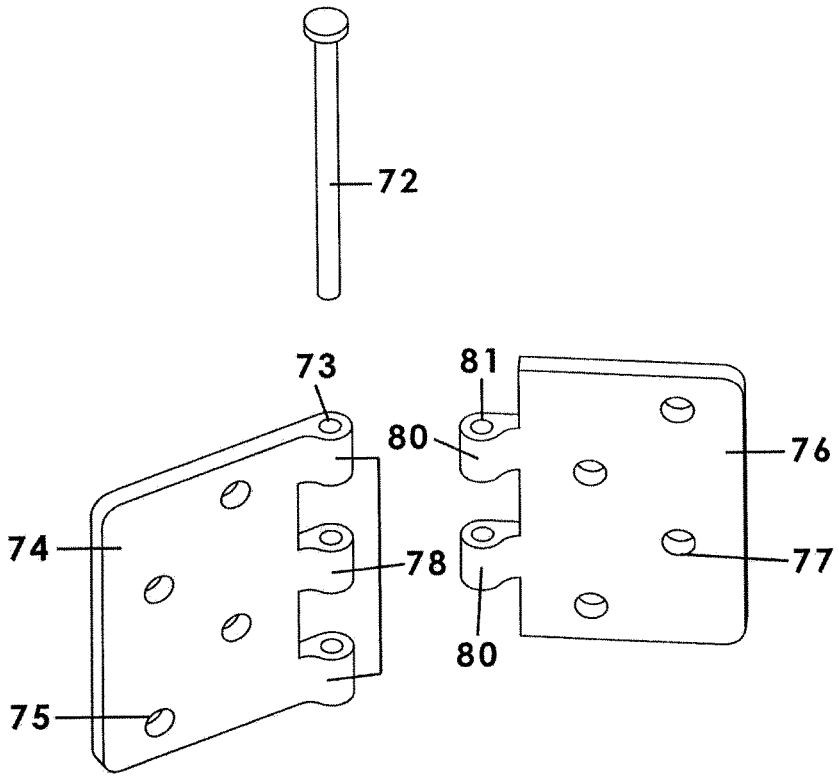
FIG. 2*a* is an exploded view of the floating hinge system as in FIG. 1*a;*

The floating hinge 70 includes a pin 72 having an elongate and linear configuration as is common to hinges (FIG. 2*a*). The floating hinge 70 also includes a first leaf 74 having at least a pair of spaced apart "first-leaf knuckles" 78 extending from an inner edge of the first-leaf 74 and rotatably coupled to the pin 72 and configured so that the first leaf 74 is selectively rotatable about the pin 72. The floating hinge 70 includes a second leaf 76 having at least one second-leaf knuckle 80 extending from an inner edge thereof and rotatably coupled to the pin 72 and situated between the pair of spaced apart first-leaf knuckles 78.

Figure 1B:
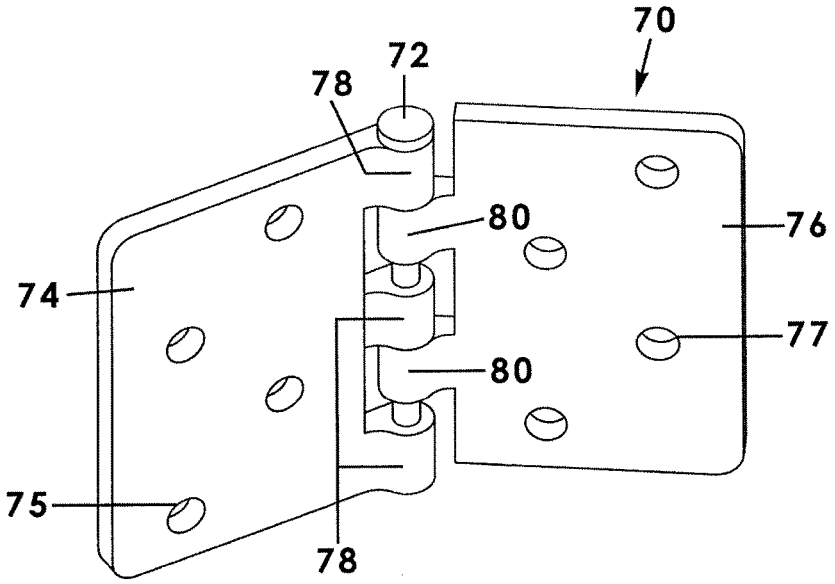
FIG. 1*b* is a perspective view of the floating hinge system as in FIG. 1*a* illustrated in a raised configuration.
Figure 2B:
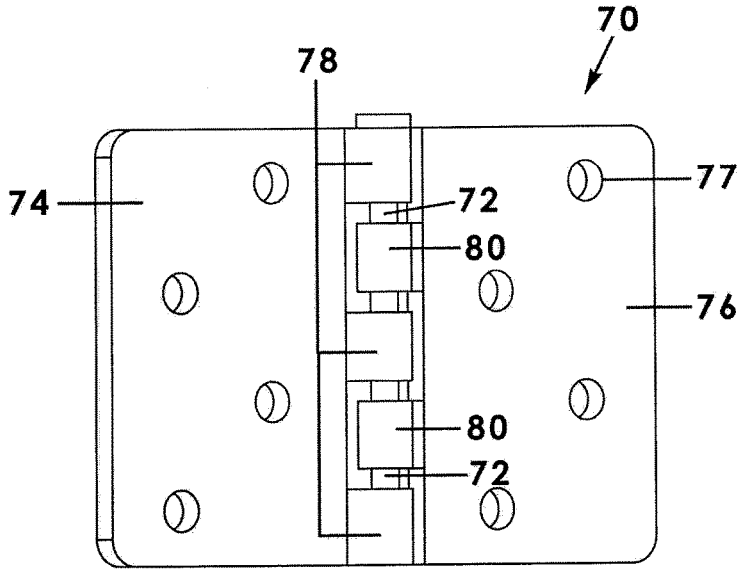
FIG. 2*b* is a front view of the floating hinge system as in FIG. 1*a.*

More particularly, the second-leaf knuckle 80 is configured to slide up and down along the pin 72 between the pair of spaced apart first-leaf knuckles 78, the first-leaf knuckles 78 defining a space therebetween. To accomplish this configuration, the second-leaf knuckle 80 is smaller than the space between the pair of first-leaf knuckles 78. FIGS. 1*b* and 2*b* may be compared to understand how the first leaf 74 and second leaf 76 are adjusted vertically relative to one another.

Each first-leaf knuckle 78 may have a generally cylindrical configuration and define a first-leaf vertical channel 73 configured to receive the pin 72 therethrough (FIG. 2*a*). Similarly, each second-leaf knuckle 80 may have a generally cylindrical configuration and define a second-leaf vertical channel 81 configured to receive the pin 72 therethrough. It is understood that the pin 72, respective first-leaf channels 73, and respective second-leaf channels 81 define a common imaginary vertical axis. Accordingly, the first leaf 74 and second leaf 76 are selectively rotatable about the vertical axis by way of respective first-leaf knuckles 78 and second-leaf knuckles 80, respectively.

In addition, the first-leaf 74 has a generally planar surface and configuration and defines a plurality of spaced apart first-leaf apertures 75. By way of example, the first leaf 74 may be attached to a respective side of a work piece by extending fasteners such as screws through respective first-leaf apertures 75 into the work piece. Similarly, the second leaf 76 has a generally planar surface and configuration and defines a plurality of spaced apart first-leaf apertures 77. The second leaf 76 may be attached to a respective side of a work piece by extending fasteners such as screws through respective second-leaf apertures 75 into the work piece.

By way of example but not of limitation, the floating hinge 70 according to the present invention may be utilized with a furniture or storage product in the form of an adjustable shelving system 10. The shelving system 10 includes a base member 20 (also referred to as a base shelving unit), a plurality of first shelf assemblies 40 pivotally coupled to a first side 24 of the base member 20, and a plurality of second shelf assemblies 50 pivotally coupled to a second side 28 of the base member 20. One or more rollers 60 may be coupled to a bottom surface of each shelf assembly to facilitate movement thereof. Each shelf assembly may be pivotally coupled to the base member 20 with a floating hinge 70 that enables a respective shelf assembly to float upward or downward as it moves on an uneven floor surface or over a small obstacle.

Figure 3:
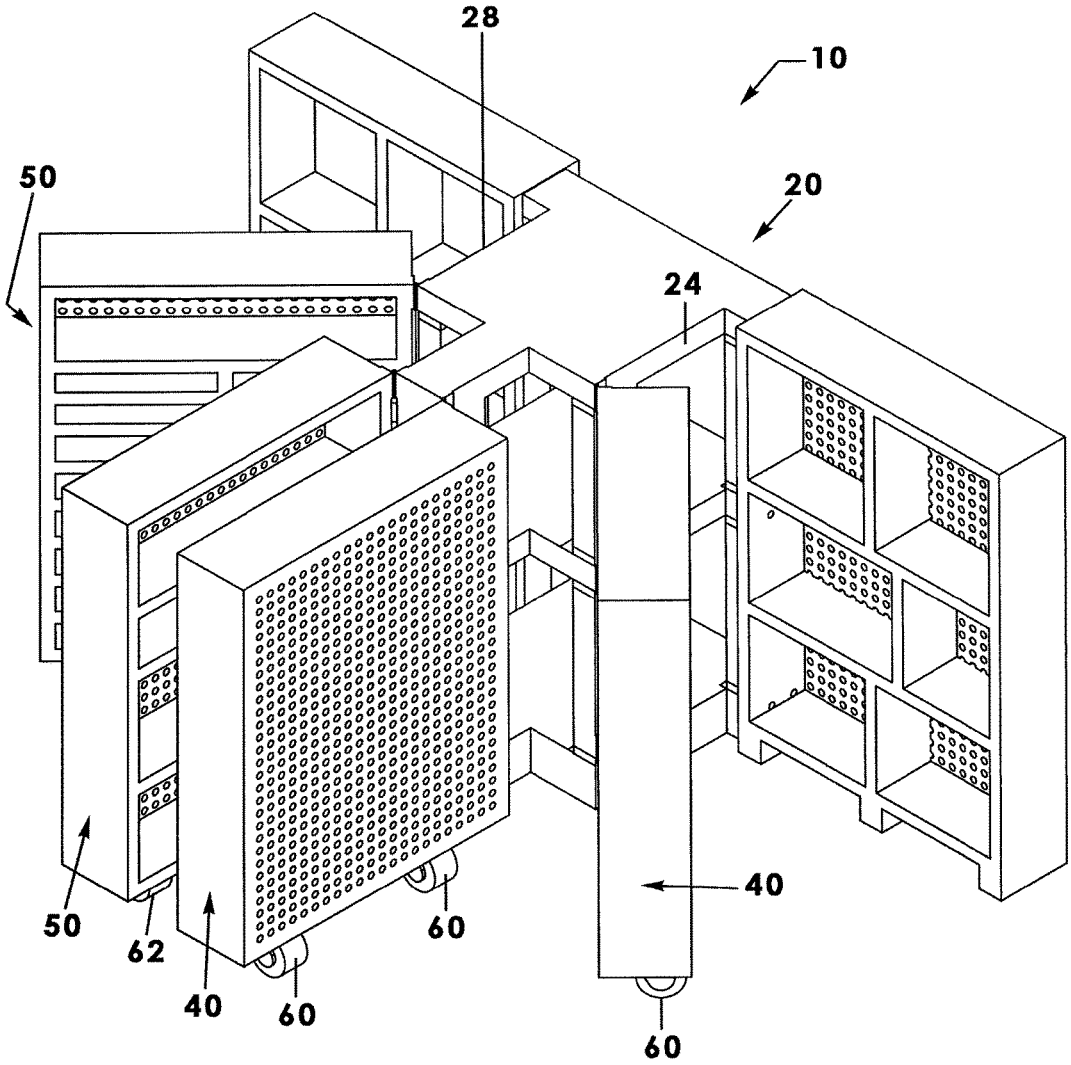
FIG. 3 is a perspective view of the floating hinge system in use with an adjustable shelving system illustrated with selected shelf assemblies in forward configurations.
Figure 4A:
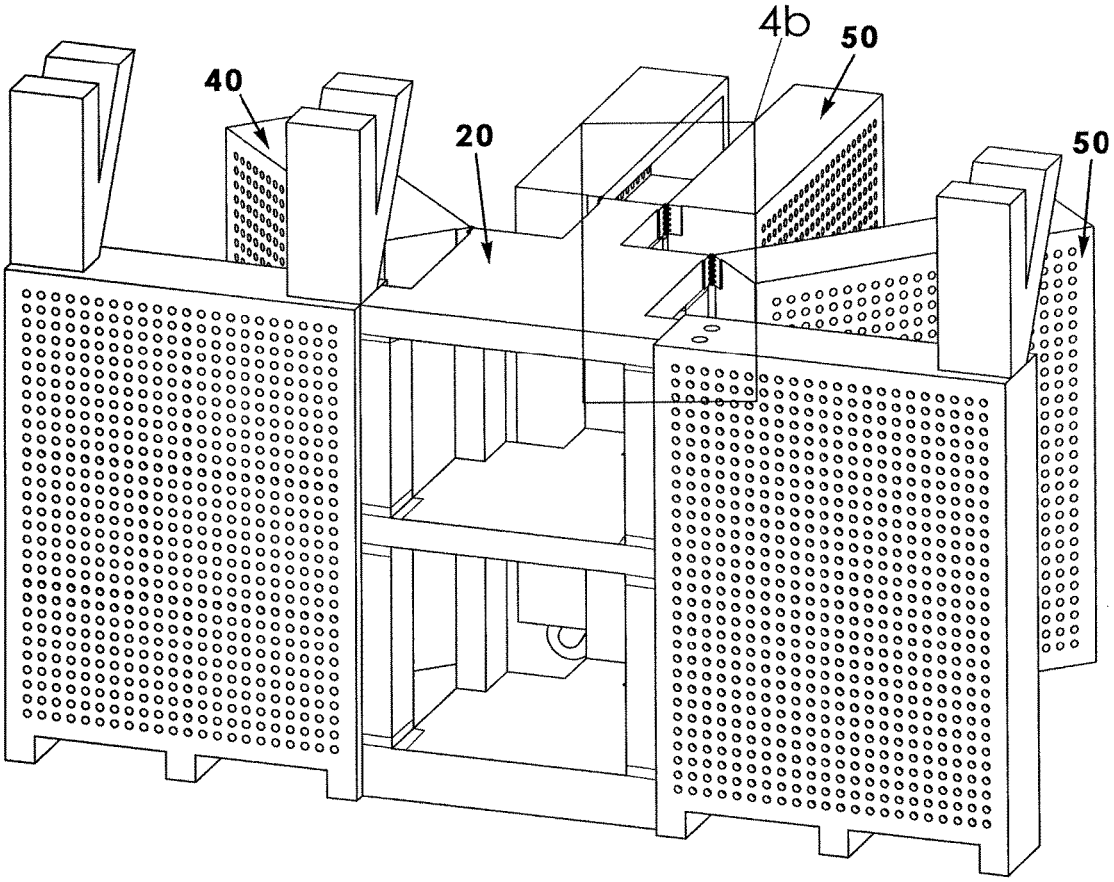
FIG. 4*a* is a perspective rear view of the floating hinge system as in FIG. 1*a* pivotally coupling portions of the shelving system.
Figure 4B:
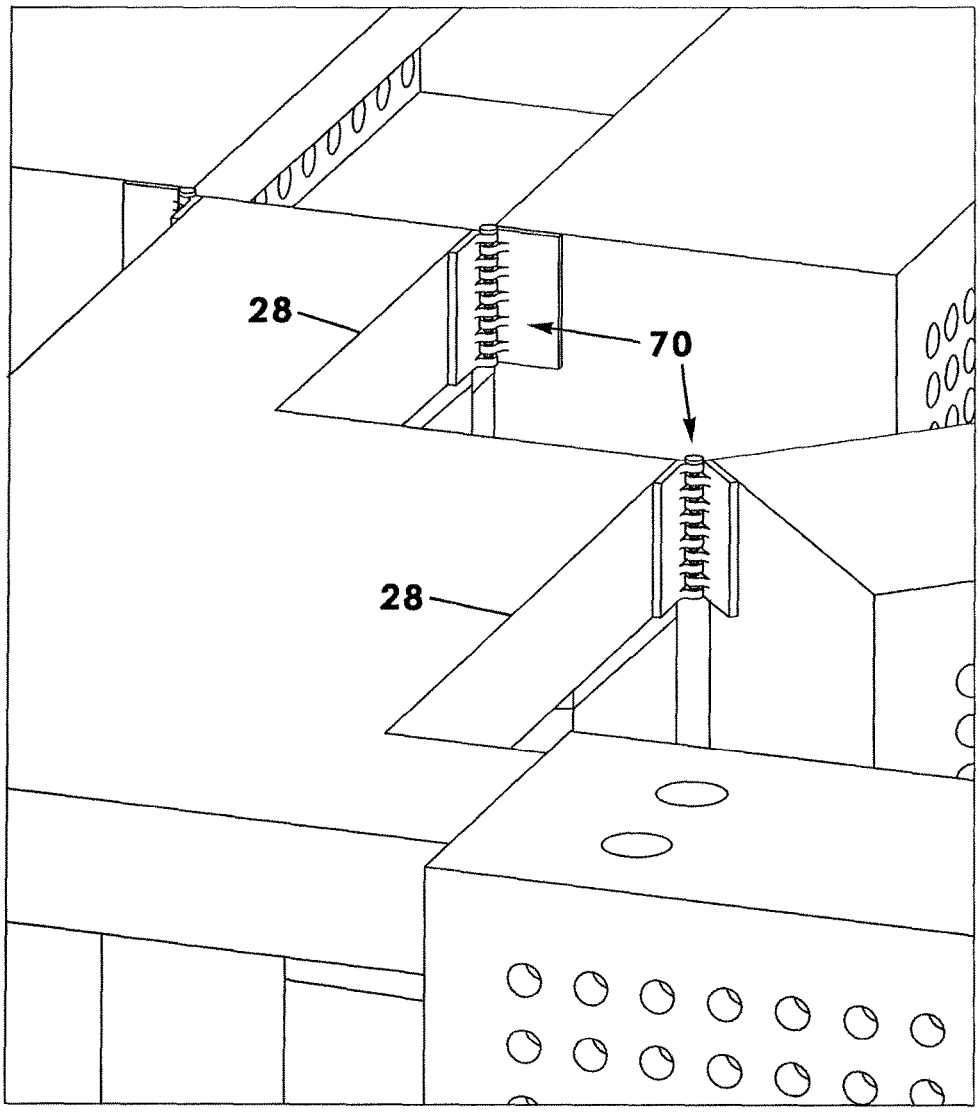
FIG. 4*b* is an isolated view on an enlarged scale taken from a portion of FIG. 4*a;*

To understand the function and operation of the floating hinge 70, FIGS. 3 to 4*b* show the plurality of shelf assemblies include rollers 60 or wheels to enhance and support the pivotal movement thereof described previously. More particularly, at least one first roller 60 is coupled to an underside of each first shelf assembly 40 (FIG. 3). Each first roller 60 is robust and configured to support a respective first shelf assembly 40 on a floor surface and to provide smooth movement between said first rearward configuration and the first forward configuration. The first rollers 60 are relied upon to support some of the weight of respective first shelf assemblies 40 when floating hinges are used to couple respective first shelf assemblies 40 to the base member 20 as will be described later. Similarly, at least one second roller 62 is coupled to an underside of each second shelf assembly 50 (FIG. 3). The function of each second roller 62 is the same as that of each first roller 60 and need not be explained in detail.

Increased weight and stress is placed on the hinges 70 coupling the shelf assemblies if the floor surface is not level. For instance, if a first shelf assembly 40 supported by a roller 60 is being pivotally moved and the floor surface slants downwardly, the respective roller 60 that is fixedly attached to that first shelf assembly 40 will no longer be in contact with the recess in the floor and the weight of the first shelf assembly 40 is unsupported by the roller 60.

In use, the first leaf 74 would be fixedly attached to the first side 24 of the base member 20 while the second leaf 76 would be fixedly attached to a respective first shelf assembly 40. When the first shelf assembly 40 is swinging/pivoting as described above and the corresponding first roller 60 rolls upon an obstacle or the floor surface inclines, the second leaf 76 is urged upwardly along the hinge pin 72 and the entire respective first shelf assembly 40 is moved upwardly. When the first roller 60 rolls down from the obstacle or the floor surface levels out, the second leaf 76 is naturally urged downwardly along the hinge pin 72. It can be seen that the floating hinge 70 relieves the strain that would be put on a traditional hinge 70 experienced by rotating without the support of a roller and without the ability to adjust vertically as a result of obstacles or uneven surfaces.

It is understood that while certain forms of this invention have been illustrated and described, it is not limited thereto except insofar as such limitations are included in the following claims and allowable functional equivalents thereof.

The invention claimed is:

1. A vertically floating hinge system for attachment to a swinging work piece, comprising:

a pin having a linear configuration;

a first leaf having a pair of spaced apart first-leaf knuckles rotatably coupled to said pin and being spaced apart from one another so as to define a first-leaf space therebetween, each first-leaf knuckle defining a first-leaf knuckle channel configured to receive said pin therethrough; and a second leaf having at least one second-leaf knuckle rotatably coupled to said pin, said second-leaf knuckle situated between said pair of spaced apart first-leaf knuckles and configured to slide along said pin between said pair of first-leaf knuckles;

wherein said at least one second-leaf knuckle is smaller than said first-leaf space so as to selectively slide vertically along said pin between said pair of first-leaf knuckles;

an upstanding base member having a first side and a second side opposite said first side;

a plurality of first shelf assemblies pivotally coupled to said first side of said base member, each first shelf assembly being movable between a first rearward configuration generally perpendicular to said base member and a first forward configuration forwardly offset relative to said rearward configuration;

wherein said first leaf includes a planar surface coupled to said base member and said second leaf includes a planar surface coupled to a respective one of the first shelf assemblies;

a plurality of second shelf assemblies pivotally coupled to said second side of said base member, each second shelf assembly being movable between a second rearward configuration generally perpendicular to said base member and a second forward configuration forwardly offset relative to said rearward configuration;

wherein said base member is a base shelving unit having a bottom shelf, an intermediate shelf upwardly displaced from said bottom shelf, and an upper shelf upwardly displaced from said intermediate shelf;

wherein said base shelving unit defines an open front, an open first side, and an open second side.

2. The vertically floating hinge system as in claim 1, wherein said pin and respective first-leaf channels define a common imaginary vertical axis.

3. The vertically floating hinge system as in claim 2, wherein said first leaf and said second leaf are selectively rotatable about said common imaginary vertical axis via said pair of first-leaf knuckles and said at least one second-leaf knuckle, respectively.

4. The vertically floating hinge system as in claim 1, wherein:

said first-leaf has a generally planar configuration and defines a plurality of spaced apart first-leaf apertures; and said second-leaf has a generally planar configuration and defines a plurality of spaced apart second-leaf apertures.

5. The vertically floating hinge system as in claim 1, comprising:

a plurality of first rollers, at least one first roller being coupled to an underside of each first shelf assembly and configured to support a respective first shelf assembly on a floor surface and to enhance movement between said first rearward configuration and said first forward configuration; and a plurality of second rollers, at least one second roller being coupled to an underside of each second shelf assembly and configured to support a respective second shelf assembly on a floor surface and to enhance movement between said second rearward configuration and said second forward configuration.

* * * * *